United States Patent [19]

Camillo

[11] 4,019,855

[45] Apr. 26, 1977

[54] ELECTRICAL SWITCH FOR IGNITION IN GAS APPLIANCES

[75] Inventor: Charles Carl Camillo, Western Springs, Ill.

[73] Assignee: Illinois Tool Works Inc., Chicago, Ill.

[22] Filed: Oct. 14, 1975

[21] Appl. No.: 622,216

[52] U.S. Cl. ..... 431/256; 126/39 E
[51] Int. Cl.[2] ..... F23Q 7/12
[58] Field of Search ..... 431/255, 256, 39 E; 317/96

[56] References Cited

UNITED STATES PATENTS

| | | | |
|---|---|---|---|
| 1,735,834 | 11/1929 | Mayo | 431/256 |
| 2,037,148 | 4/1936 | Reeves | 431/256 X |
| 3,436,165 | 4/1969 | Gehrke | 431/256 |

*Primary Examiner*—Edward G. Favors
*Attorney, Agent, or Firm*—Glena W. Bowen; Robert W. Beart

[57] ABSTRACT

Disclosed is a switch structure for use in a gas-fired appliance. The switch is simultaneously operated by rotation of a gas valve on an appliance such as a cooking stove. The switch has a semi-circular cam body disposed within a housing. The cam body is secured to the stem of the gas valve for rotation therewith. An arcuately extending cam guide is located on the periphery of the body and extends transversely of the axis of rotation. A cam lobe is also provided on the cam body immediately adjacent the cam guide and only at one side thereof. A flexible wire contact element is engagable with the cam guide and is actuated by the cam lobe to make electrical contact with a stationary contact element when the cam body is rotated in one direction. The flexible wire contact is engagable with the cam guide and directed away from the cam lobe to avoid electrical connection when the cam body is rotated in the opposite direction, during, for example, turning off and/or adjusting the level of the flame of the gas burner.

7 Claims, 9 Drawing Figures

ELECTRICAL SWITCH FOR IGNITION IN GAS APPLIANCES

BACKGROUND OF THE INVENTION

This invention relates generally to an electric switch structure for use in a gas-fired appliance such as a cooking stove and the like. Particularly, the present invention is directed to a switch structure which can be adapted to present manually operated gas valves to provide electrical contact for an igniter when the gas valve is turned in one direction for turning on a gas burner, which switch structure further is constructed for preventing energization of the electric igniter when the gas valve is turned in the other direction for turning off or adjusting the level of the flame of the gas burner.

Electric igniters for gas-fired furnaces are well known in the art. However, gas-fired appliances such as gas stoves and the like presently usually require a continuously burning pilot light to ignite the combustible gas-air fuel mixture. Generally, this type of appliance utilizes manually operated gas valves which are connected to a gas supply line and wherein air is intermixed with natural gas at the outlet of the gas valve. The air-gas mixture is then delivered along a tube to the gas burner where it is ignited by the pilot light. This type of appliance continuously utilizes gas to maintain the pilot light so that considerable gas energy may be wasted.

SUMMARY OF THE INVENTION

Accordingly, it is an object of this invention to provide a new and improved switch structure for an igniter system for use with a gas-fired appliance.

Still another object of this invention is to provide a new and improved switch structure to be utilized in conjunction with a manually operated gas valve.

A feature of this invention is the utilization of a cam structure and an electrical contact which makes electrical connection for energizing an igniter when the cam is rotated in one direction, but makes no electrical connection when the cam is rotated in the opposite direction during, for example, turning off and/or adjusting the quantity of the gas-air mixture delivered to the burner.

Many other objects, features and advantages of this invention will be more fully realized and understood from the following detailed description when taken in conjunction with the accompanying drawings wherein like reference numerals throughout the various views of the drawings are intended to designate similar elements and components.

DETAILED DESCRIPTION OF THE ILLUSTRATED EMBODIMENT

Figure 1:
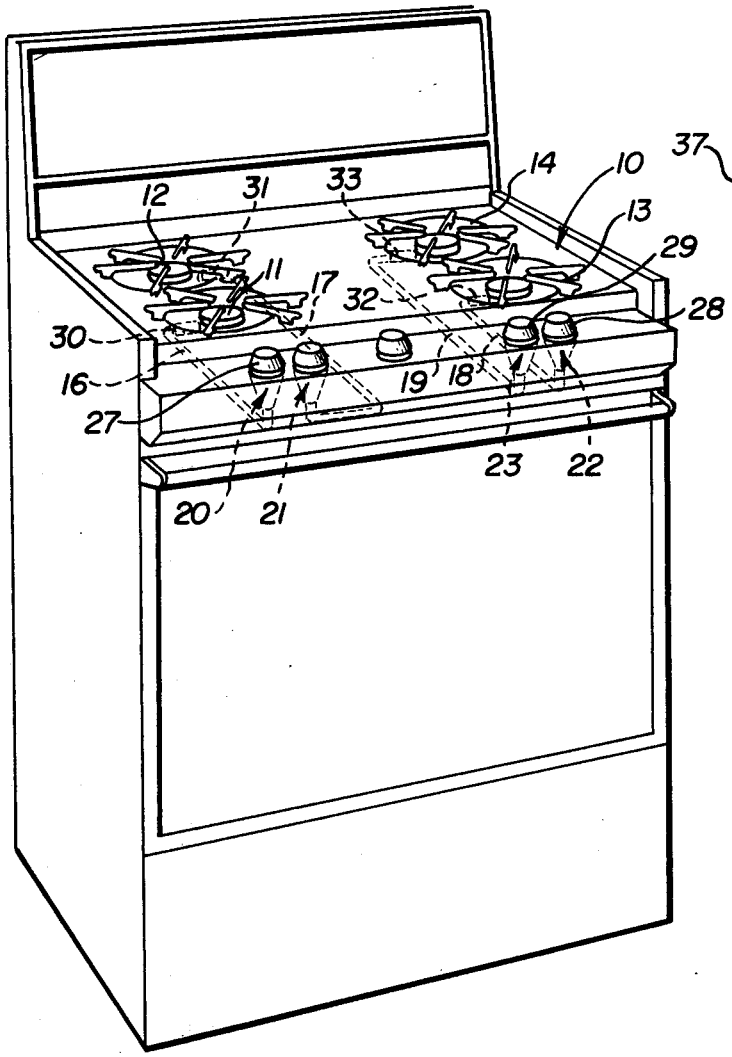
FIG. 1 is a perspective view of the top portion of a gas operated cooking stove which includes a switching device of this invention.

Referring now to FIG. 1, there is seen the top of a cooking stove which is designated generally by reference numeral 10 and wherein a novel switch structure of this invention is utilized. The cooking stove top 10 is here shown having four burners 11, 12, 13 and 14 which represent four distinct cooking areas on the stove. The burners 11–14 are supplied with a combustible gas-air mixture through conduit means 16, 17, 18 and 19, respectively. The combustible gas-air mixture is mixed from a supply and mixing valves 20, 21, 22 and 23 respectively. The gas-air mixing valves are of well known design and include manually operated knobs 26, 27, 28 and 29, respectively. The manually operated knobs are turned, for example, counterclockwise to cause the valve to open and deliver a gas-air mixture to the associated burner, and clockwise to reduce the flame and to turn off the gas-air flow.

In the illustrated embodiment, the burners 11, 12, 13 and 14 have associated therewith electric igniters 30, 31, 32 and 33, respectively. The electric igniters 30–33 are of any suitable well know type which can be energized either by DC electric current or by a standard alternating current source of the 60 cycle 115 volt type.

Figure 2:
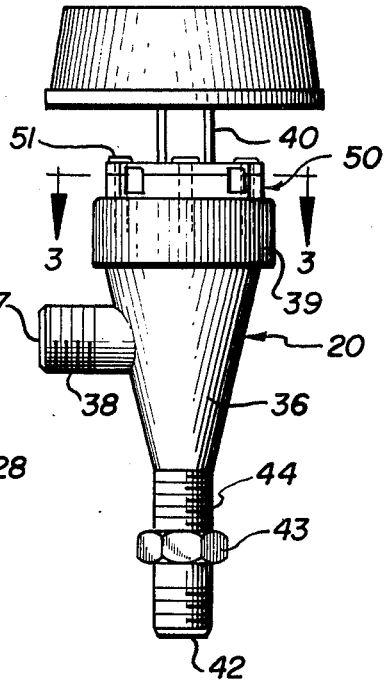
FIG. 2 is a side elevational view of a standard gas-air mixing valve for the cooking stove of FIG. 1.

Referring now to FIG. 2, there is seen the details of the gas-air mixing valve 20, it being understood to be typical of the valves 20–23. The valve 20 includes a valve body 36 which has an inlet 37 provided with threads 38 to receive a suitable coupling for connection to a gas line. A threaded end cap 39 is secured to the body 36 and may include packing means, not shown, to provide a gas tight seal about a control know shaft 40 extending therefrom. Not seen, but understood to be well known in the art, is a gas-air mixing valve arrangement within the body 36.

The gas-air mixing valve delivers gas to an outlet indicated by reference numeral 42. A gas-air mixer adjustment 43 is located at the outlet 42. The gas-air mixing adjustment 43 is threaded and is movable along the outlet shaft indicated by reference numeral 44 in a manner well known in the art. The outlet 42 is coupled to the burner 11 through the conduit means 16 as seen in FIG. 1.

Figure 3:
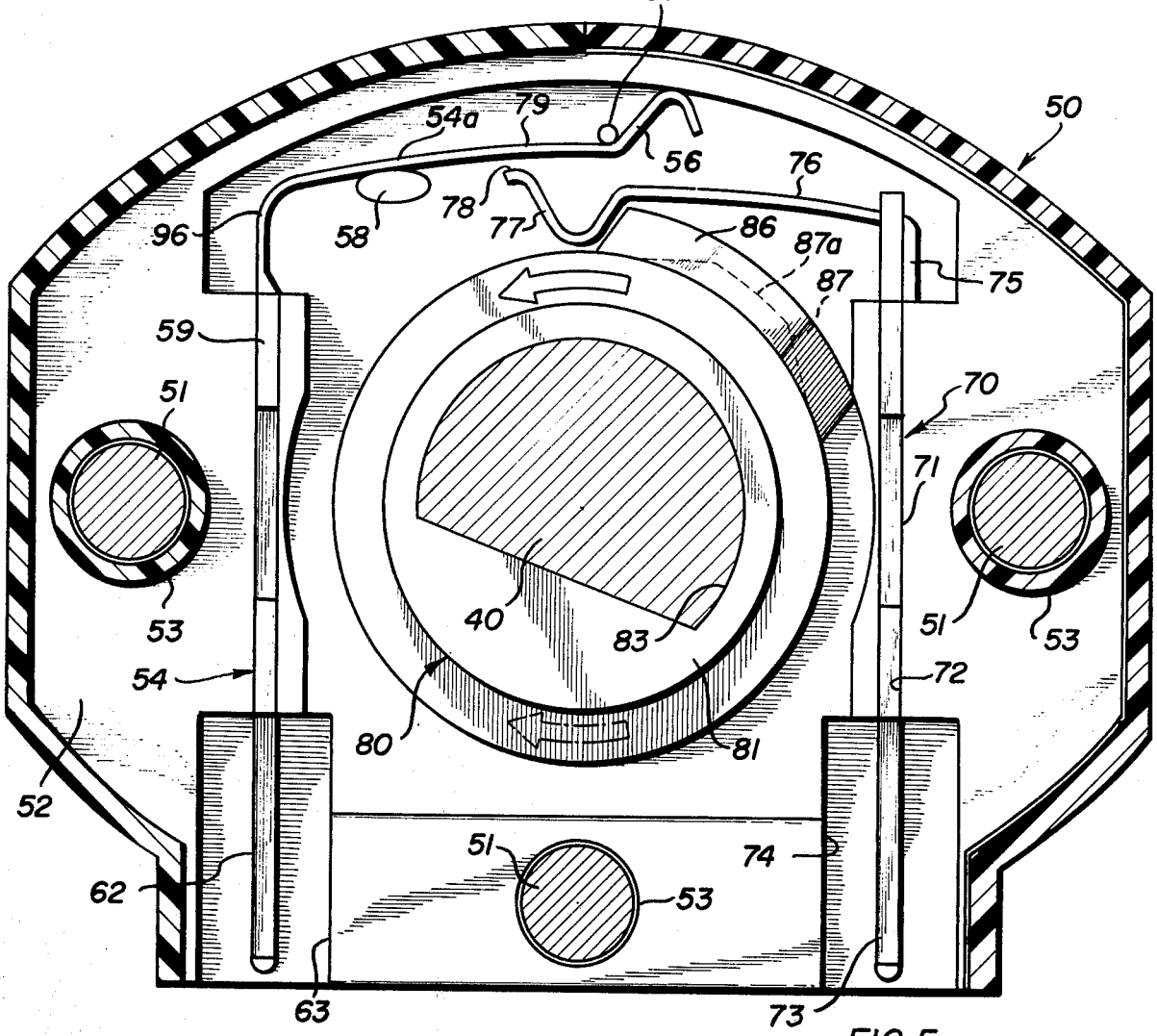
FIG. 3 is an enlarged sectional view along line 3—3 of FIG. 2 showing the construction of a switching device of this invention.

In accordance with this invention, a switch structure 50 is secured to the valve 20. A plurality of screws 51 pass through apertures in the switch 50 and are threaded into the end cap 39 of the valve 20 for securing the switch in place. The switch structure 50 has a rotating cam 80 mounted therein and described in detail below. The cam has a semi-circular aperture 83 as shown in FIG. 3 for accommodating the shaft 40, which is also semi-circular in configuration, passing therethrough. Rotation of the shaft 40 causes the cam within the switch body to rotate therewith.

Referring specifically to FIG. 3, the switch structure 50 includes a switch housing 52 through which are formed apertures 53 to receive the mounting screws 51, as seen in FIG. 2. The switch housing contains a fixed electrical contact element 54 having a bight portion 56 at one end thereof. The switch contact element 54 includes a relatively thin, flexible portion 54*a* held in place in the switch housing by a pair of formed pins 57 and 58. The fixed contact also includes a relatively thick stem portion 59 inserted into a channel 60 formed within the housing. A terminating end of the thick stem portion 59 forms a terminal end 62 which is substantially completely contained within a cavity 63 formed as part of the switch housing. The entire switch structure, except for the electrical contact elements, is made of plastic or other nonconductive material.

A second flexible contact element 70 is mounted within the switch housing 52 and includes a broad stationary portion 71 secured in a channel 72 of the switch housing. This fixed portion includes a terminal end 73 which is also housed within a cavity 74 similar to the cavity 63 for the terminal end 62. Electrical connection is made to the switch terminals by push-on connectors arranged so as to avoid making contact with any metal components of the stove. Any electrical connections made to the switch are completely shielded by the plastic material forming the switch housing.

The flexible switch element 70 includes a flexible wire portion 76 having one end portion 75 soldered to the element 71 and a bight portion 77 at the free end thereof. The bight portion 77 has a terminating contact end portion 78. The contact at the end portion 78 engages the relatively thin strip 54*a* in the region designated by reference numeral 79. When the end portion 78 and the region 79 come together, electrical connection is made to operate the igniter associated with the burner of the stove of FIG. 1.

In accordance with this invention, a novel cam structure is mounted within the switch body 52 and is designated generally by reference numeral 80. The cam structure 80 includes a cam body 81 which has annular flanges 82 associated therewith and on opposite sides thereof to be confined in apertures formed in the ends of the switch body. Therefore, the cam is free to rotate. As mentioned above, the cam body 81 has a semi-circular aperture 83 which conforms substantially in configuration to the semi-circular cross-section of the shaft of the valve 20 of FIG. 2. The cam body includes generally centrally located a cam guide 86 extending circumferentially or transversely of the axis of rotation thereof. The cam guide is of a predetermined arcuate length along the outer surface of the cam body. A cam lobe 87 is also formed on the cam body immediately adjacent the cam guide, but only at one side thereof.

Figure 4:
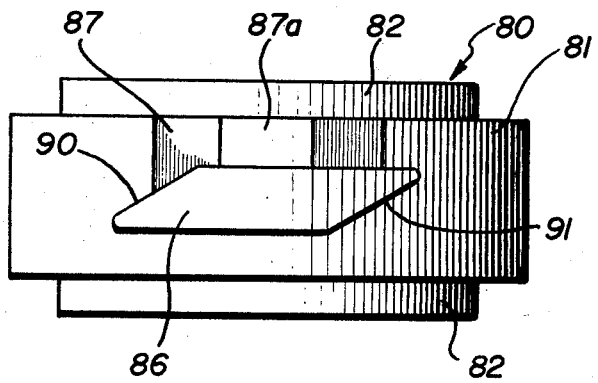
FIG. 4 is an edge view of cam body incorporated in the switching device of FIG. 3.

As shown in FIG. 4, the cam guide 86 has parallel end guide surfaces 90 and 91. These guide surfaces engage the bight portion 77 of the formed wire 76 to flex it laterally of the cam body when the cam body is rotated. For example, when the cam body is rotated in the counterclockwise direction, as seen in FIG. 3, the surface 90 of the cam guide engages the bight portion and directs it laterally so that the bight portion also engages the cam lobe 87. The cam lobe 87 will cause the bight portion 77 to rise thereby making contact between the terminating end 78 and the area 79 of the contact element 54. During a short dwell period, as determined by a flat area 87*a* of the cam lobe 87, the igniter associated with the burner is energized to ignite the gas-air mixture coming through the associated conduit. Further rotation of the cam body will cause the flat portion 87*a* to pass the bight portion 77 and drop the formed wire 76 again to the level of the cam body.

Rotation of the cam body in the opposite direction will cause the guide surface 91 to engage the bight portion and direct it laterally away from the cam so that no electrical connection is made between the end 78 and the area 79. Therefore, the switch structure of this invention provides means for energizing an igniter when rotating the switch in one direction while preventing electrical energization of the igniter when it is rotated in the opposite direction.

Figure 5:
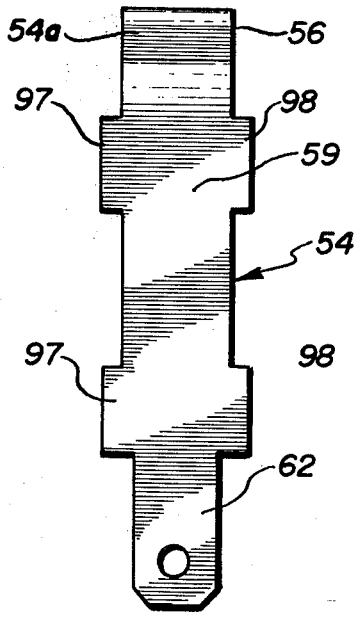
FIG. 5 is an end view of a fixed contact element shown in FIG. 3.

Referring now to FIGS. 3 and 5, there is seen the details of construction of the stationary terminal element 54. The stationary terminal element 54 includes a thinned flexible upper portion 54*a* leading into the thick portion 59 via a bend 96. FIG. 5 shows laterally extended tabs 97 and 98 associated with the thick portion 59, these tabs being inserted into correspondingly shaped recesses formed within the plastic switch body 52. In FIG. 5, it can be seen that the terminal end 62 includes an aperture 99 to receive a detent formed within the terminal element to be connected thereto, as is well known in the art.

Figure 6:
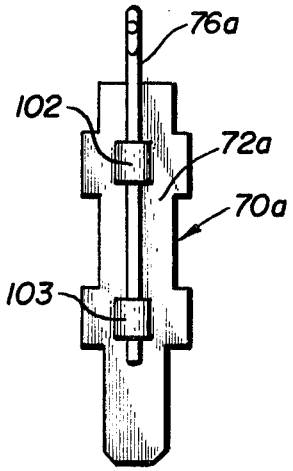
FIG. 6 is an end view of a modified form of a flexible contact element usable in the switching device of FIG. 3.
Figure 7:
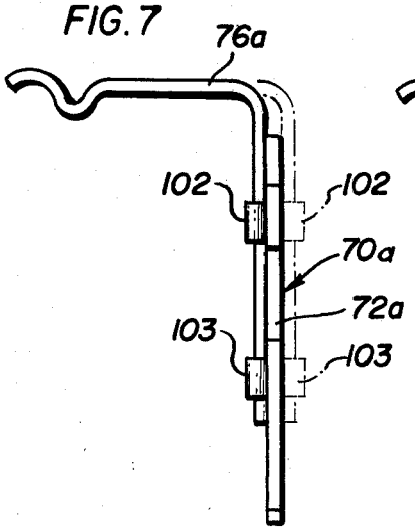
FIG. 7 is a side view of the flexible contact element of FIG. 6.

Referring now to FIGS. 6 and 7, there is seen a modified form of flexible contact element constructed in accordance with the principles of this invention. Here, the flexible contact element is designated generally by reference numeral 70*a* and includes the stationary portion 72*a* and formed wire portion 76*a*. The fixed portion 72*a* includes tabs 102 and 103 formed as a part thereof through which the formed wire 76*a* passes. The tabs can be formed by a press striking the tabs in one direction or the other from the material forming the stationary portion 72*a*. As seen in FIG. 7, the phantom lines illustrate the formed wire being secured to the fixed portion 72*a* and the back side thereof.

Figure 8:
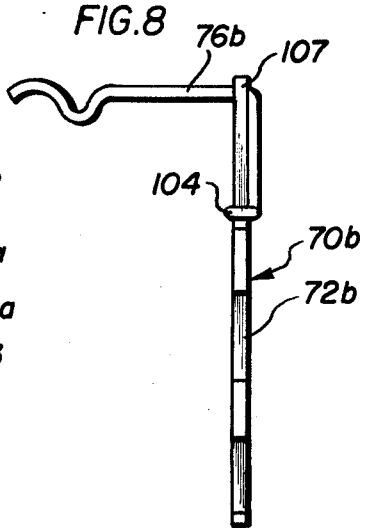
FIG. 8 is a side view of another alternate embodiment of the flexible contact element of this invention.
Figure 9:
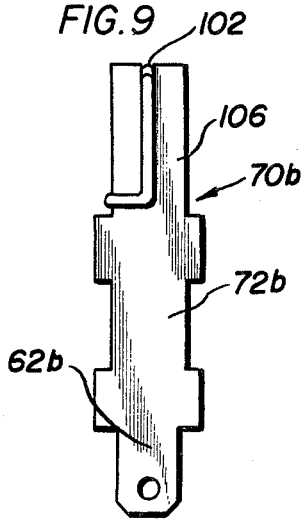
FIG. 9 is an end view of the alternate embodiment shown in FIG. 8.

FIGS. 8 and 9 show an alternate form of flexible contact element constructed in accordance with the principles of this invention and designated generally by reference numeral 70*b*. The flexible contact element 70*b* includes the fixed contact element portion 72*b* forming a terminal end 62*b*. The formed wire 76*b* is secured to the fixed portion 72*b* by a wrapped portion 104 which may be ultimately fastened thereto by spot welding along a stem portion 106. The fixed portion 72*b* may have a notch 107 formed at the upper end thereof through which passes the formed wire 76*b*.

In the embodiments shown in FIGS. 6 and 7 and in FIGS. 8 and 9, the formed wire portion is free to move both laterally and vertically. Therefore, when the cam structure within the switch is rotated in one direction, the formed wire portion will be moved laterally in the direction of the cam lobe and then vertically under the influence of the cam lobe. However, when the switch cam is rotated in the opposite direction, the formed wire is moved only laterally away from the cam lobe and no electrical connection is made.

What has been described is a simple and efficient switch structure which can be utilized in conjunction with a gas air mixing valve of a gas-fired appliance such as a cooking stove. While some modifications have been illustrated herein, it will be understood that still further variations and modifications may be incorporated without departing from the spirit and scope of the novel concepts as set forth in the following claims.

The invention is claimed as follows:

1. An electrical switch for association with a gas valve comprising housing means, a rotatable cam body disposed on said housing means, said cam body being of a predetermined width and having an axis of rotation associated therewith, a cam guide on said cam body and extending transversely of the axis of rotation thereof and along a predetermined arcuate extent of an outer surface of said cam body, a cam lobe on said cam body adjacent said cam guide at one side thereof, fixed contact means secured within said housing means and spaced from said cam body, and shiftable contact means secured within said housing means and adjacent said cam body for selective engagement with said fixed contact means, said shiftable contact means being shiftable laterally and deflectable vertically, said cam guide being constructed for engaging said shiftable contact means and shifting said shiftable contact means laterally toward said cam lobe upon rotation of said cam by a predetermined amount in one direction, said cam subsequently deflecting said shiftable contact means vertically for actuation thereby into electrical contact with said fixed contact means for a predetermined interval of rotation of said cam body from its initial position, which initial position corresponds to a closed valve, when said cam body is rotated by an additional predetermined amount in said one direction, and said cam guide being constructed for engaging and shifting said shiftable contact means laterally away from said cam lobe for preventing deflection of said shiftable contact means in said vertical direction by said cam lobe and electrical contact of said shiftable contact means with said fixed contact means when said cam body is rotated in the opposite direction to said one direction, back toward its initial position.

2. An electrical switch as set forth in claim 1 wherein said cam guide includes two substantially parallel opposite end surfaces which extend beyond the end surfaces of said cam guide providing sloping guide surfaces for shifting said shiftable contact means in a lateral direction toward or away from said cam lobe during rotation of said cam body in accordance with the direction of rotation of said cam body.

3. An electrical switch as set forth in claim 2 wherein said shiftable contact means includes a substantially flat fixed contact element secured within said housing and a flexible contact element secured to said fixed contact element, said flexible contact element initially being in alignment with said cam guide said flexible contact element being a formed wire member which is secured to said fixed contact element and which extends therefrom.

4. A switch as set forth in claim 3 wherein said formed wire member is secured to said flat member by tabs formed on said flat member, said tabs being bent partially about said formed wire member for holding it in place.

5. A switch as set forth in claim 3 wherein said formed wire member is wrapped about said flat member and secured thereto by spot welding.

6. A gas valve and electrical ignition switch structure for a gas-fired appliance, comprising: a gas valve body having an inlet for receiving gas and an outlet for delivering a combustible gas to a burner, a stem extending from said gas valve body for rotation about its longitudinal axis for turning said gas valve between a closed and an open position, an electrical switch comprising housing means secured to said gas valve body and adjacent said stem, a rotatable cam body of predetermined width and having an axis of rotation associated therewith, fixed with respect to and rotatable with said stem, a cam guide on said cam body and extending transversely of the axis of rotation thereof and along a predetermined arcuate extent of the outer surface of said cam body, a cam lobe on said cam body adjacent said cam guide at one side thereof, fixed electrical contact means mounted in said housing means, and shiftable electrical contact means in said housing means and positioned adjacent said cam body for selective engagement with said fixed contact means said cam guide being constructed for engaging said shiftable contact means and shifting said shiftable contact means laterally toward said cam lobe upon rotation of said cam by a predetermined amount in one direction, said cam subsequently deflecting said shiftable contact means vertically for actuation thereby into electrical contact with said fixed contact means for a predetermined interval of rotation of said cam body from its initial position, which initial position corresponds to a closed valve, when said cam body is rotated by an additional predetermined amount in said one direction, and said cam guide being constructed for engaging and shifting said shiftable contact means laterally away from said cam lobe for preventing deflection of said shiftable contact means in said vertical direction by said cam lobe and electrical contact of said shiftable contact means with said fixed contact means when said cam body is rotated in the opposite direction to said one direction, back toward its initial position.

7. A gas valve and electrical switch structure as set forth in claim 6 wherein said cam guide includes two substantially parallel opposite end surfaces which extend beyond the end surfaces of said cam guide providing sloping guide surfaces for shifting said shiftable contact means in a lateral direction toward or away from said cam lobe during rotation of said cam body in accordance with the direction of rotation of said cam body.

* * * * *